US011179623B2

(12) United States Patent
Sublet et al.

(10) Patent No.: US 11,179,623 B2
(45) Date of Patent: Nov. 23, 2021

(54) SUPPORT PLATE FOR A GLIDING BOARD

(71) Applicant: SALOMON S.A.S., Epagny Metz-Tessy (FR)

(72) Inventors: Benoît Sublet, Sevrier (FR); Joël Mepal, Annecy (FR)

(73) Assignee: SALOMON S.A.S., Epagny Metz-Tessy (FR)

( * ) Notice: Subject to any disclaimer, the term of this patent is extended or adjusted under 35 U.S.C. 154(b) by 0 days.

(21) Appl. No.: 16/890,373

(22) Filed: Jun. 2, 2020

(65) Prior Publication Data

US 2020/0376360 A1 Dec. 3, 2020

(30) Foreign Application Priority Data

Jun. 3, 2019 (FR) ..... 1905863

(51) Int. Cl.
*A63C 9/20* (2012.01)
*A63C 9/00* (2012.01)
*A63C 9/18* (2012.01)

(52) U.S. Cl.
CPC ..... *A63C 9/20* (2013.01); *A63C 9/003* (2013.01); *A63C 9/18* (2013.01)

(58) Field of Classification Search
CPC ..... A63C 9/003; A63C 9/18
See application file for complete search history.

(56) References Cited

U.S. PATENT DOCUMENTS 5,280,942 A 1/1994 Ruffinengo
5,320,377 A * 6/1994 Ruffinengo ..... A63C 9/00 280/602
5,326,126 A * 7/1994 Ruffinengo ..... A63C 5/07 280/602
5,393,086 A * 2/1995 Le Masson ..... A63C 5/07 280/602
5,879,019 A * 3/1999 Mantel ..... A63C 9/00 280/620

(Continued)

FOREIGN PATENT DOCUMENTS

EP 0557737 A2 9/1993
EP 0595170 A1 5/1994

(Continued)

OTHER PUBLICATIONS

French Search Report issued in French Patent Application No. 1905863, dated Feb. 4, 2020.

*Primary Examiner* — Brian L Swenson
(74) *Attorney, Agent, or Firm* — Greenblum & Bernstein, P.L.C.

(57) ABSTRACT

A support plate for a binding for a gliding board that includes the following: a chassis to be fixed on an upper surface of the gliding board; a damping plate intended to be at least partially interposed between a lower surface of the chassis and the upper surface of the gliding board. The support plate includes a wedge that is less compressible than the damping plate, movable between a hardness configuration, suitable for transmitting a vertical force from the chassis to the upper surface of a gliding board, and inhibiting, at least partially, the compression of the damping plate and between a flexibility configuration, suitable for the force to be retransmitted from the chassis to the upper surface of a gliding board, mainly via the damping plate.

19 Claims, 6 Drawing Sheets

(56) References Cited

U.S. PATENT DOCUMENTS

| | | | | |
|---|---|---|---|---|
| 6,666,472 | B2 * | 12/2003 | Joubert Des Ouches | A63C 10/18<br>280/14.21 |
| 6,991,240 | B2 * | 1/2006 | Grella | A63C 10/22<br>280/11.14 |
| 2012/0190473 | A1 * | 7/2012 | Swist | A63B 60/10<br>473/282 |

FOREIGN PATENT DOCUMENTS

| | | | |
|---|---|---|---|
| FR | 2431306 | A1 | 2/1980 |
| FR | 2655867 | A1 | 6/1991 |
| FR | 2657269 | A1 | 7/1991 |

* cited by examiner

[Fig. 1]
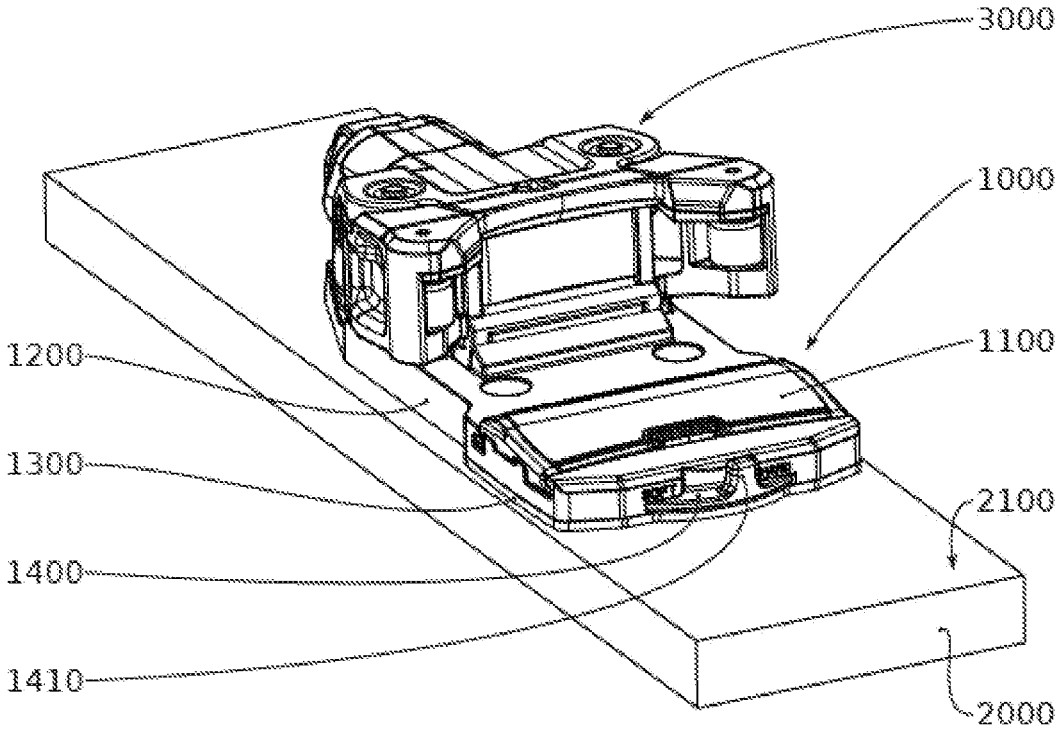

[Fig. 2]
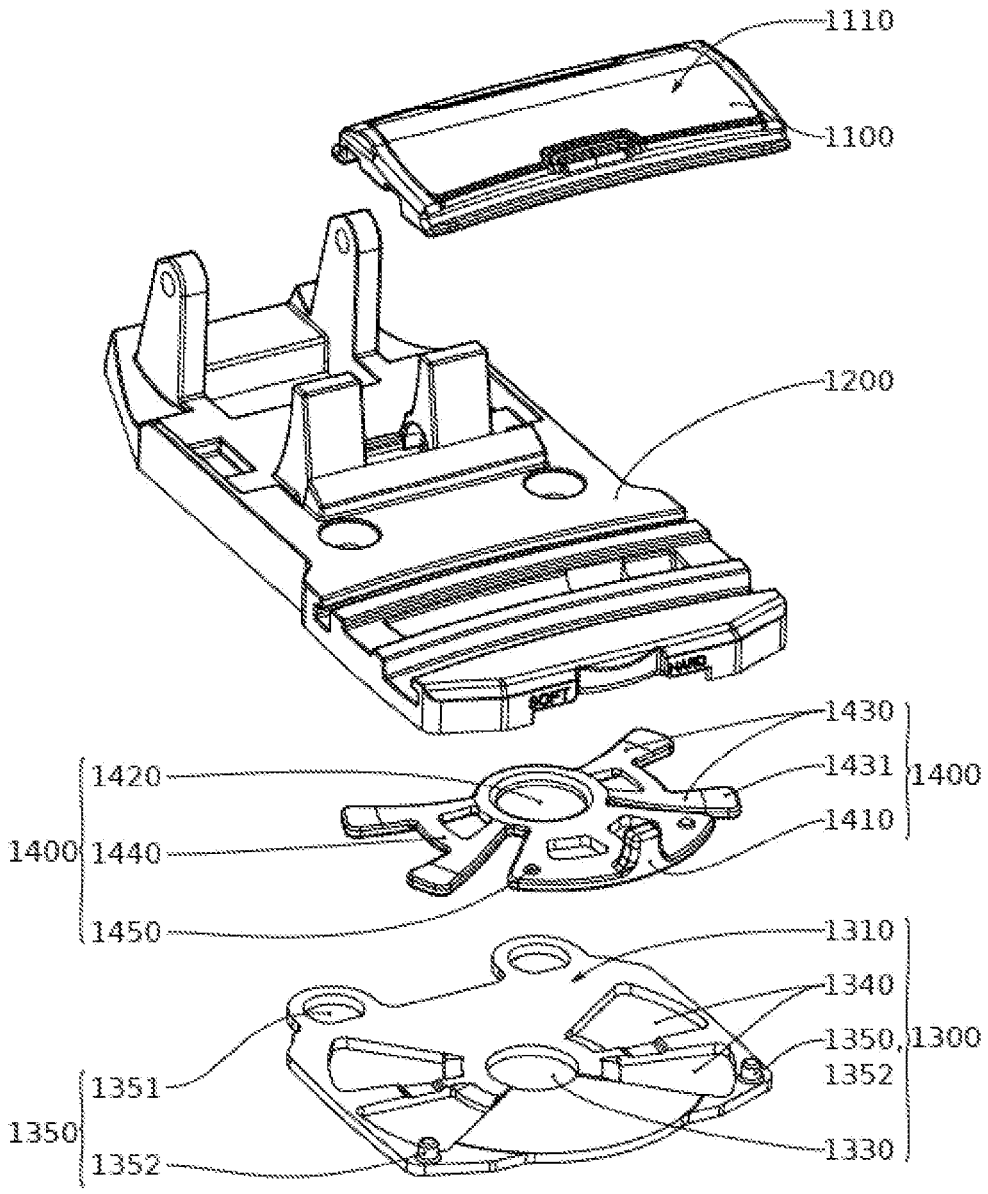

[Fig. 3]
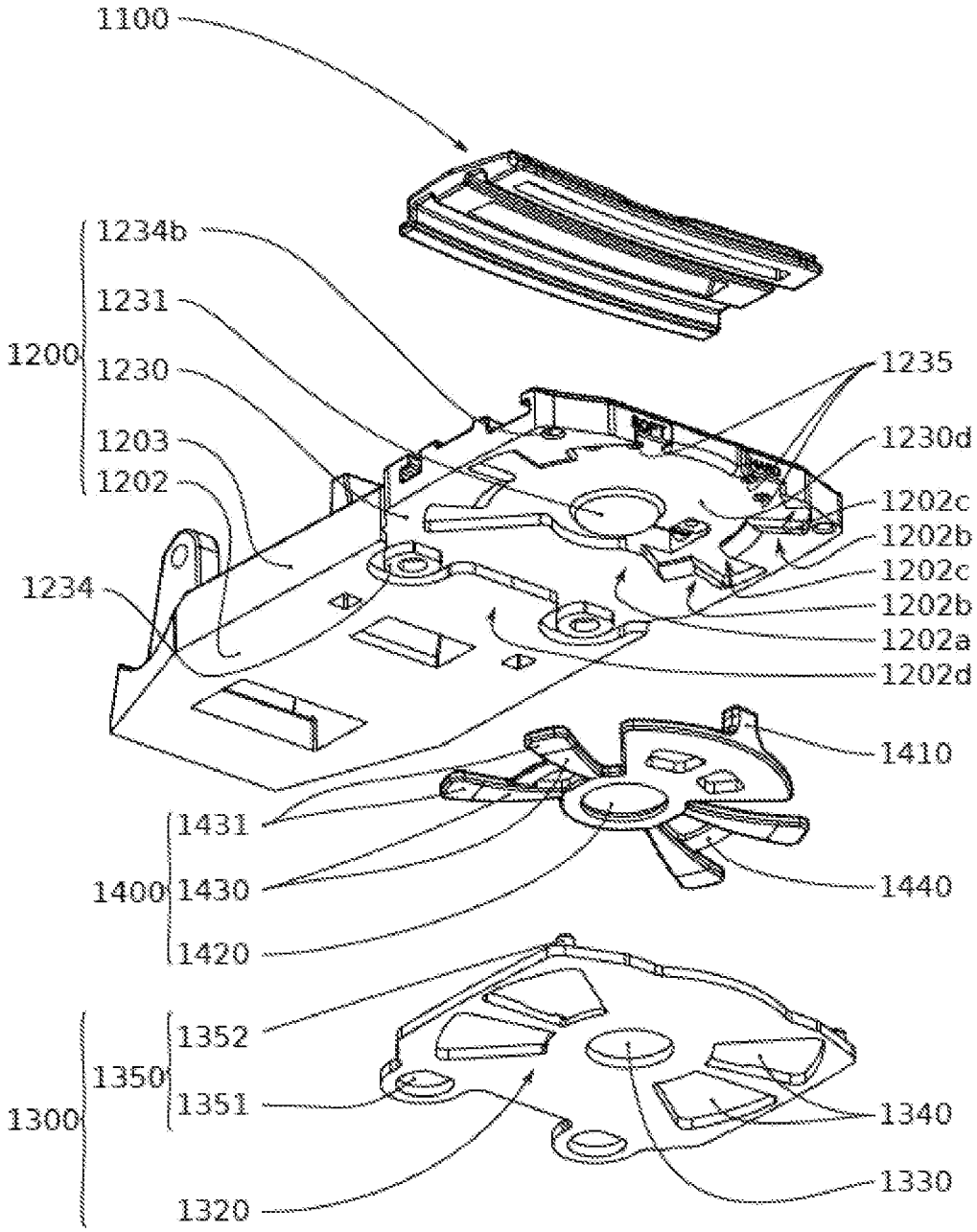

[Fig. 4A]
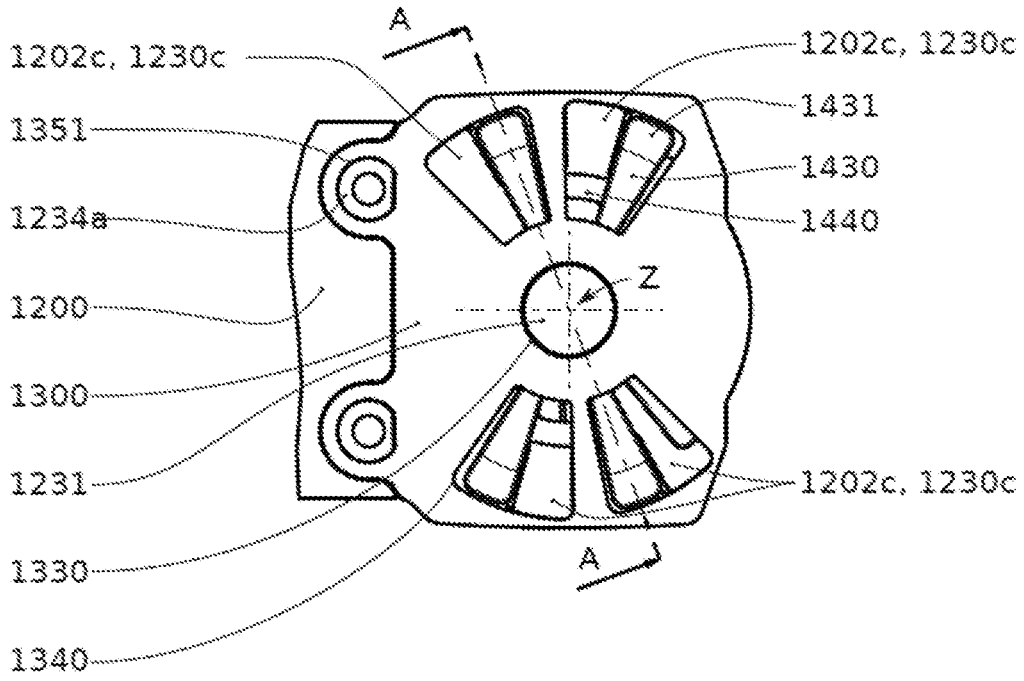
[Fig. 4B]
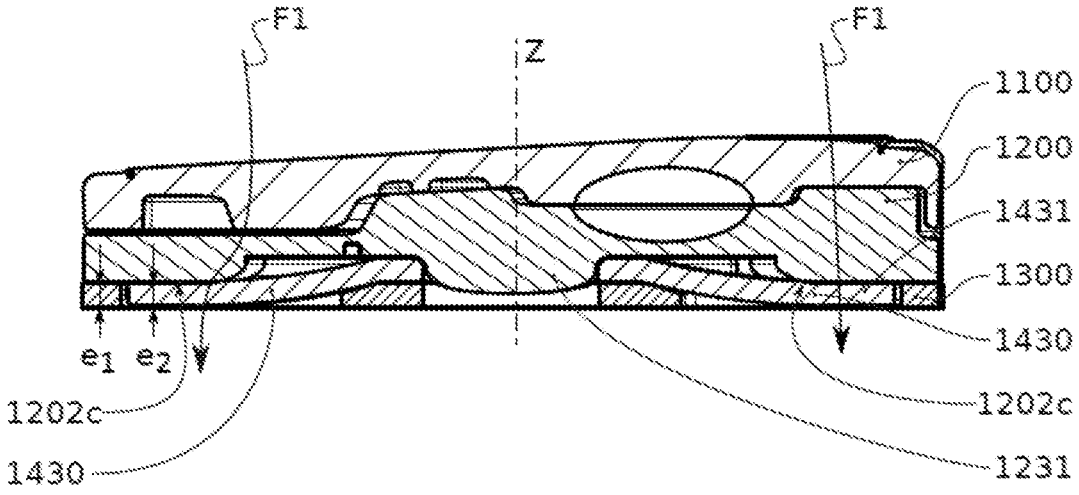

[Fig. 5A
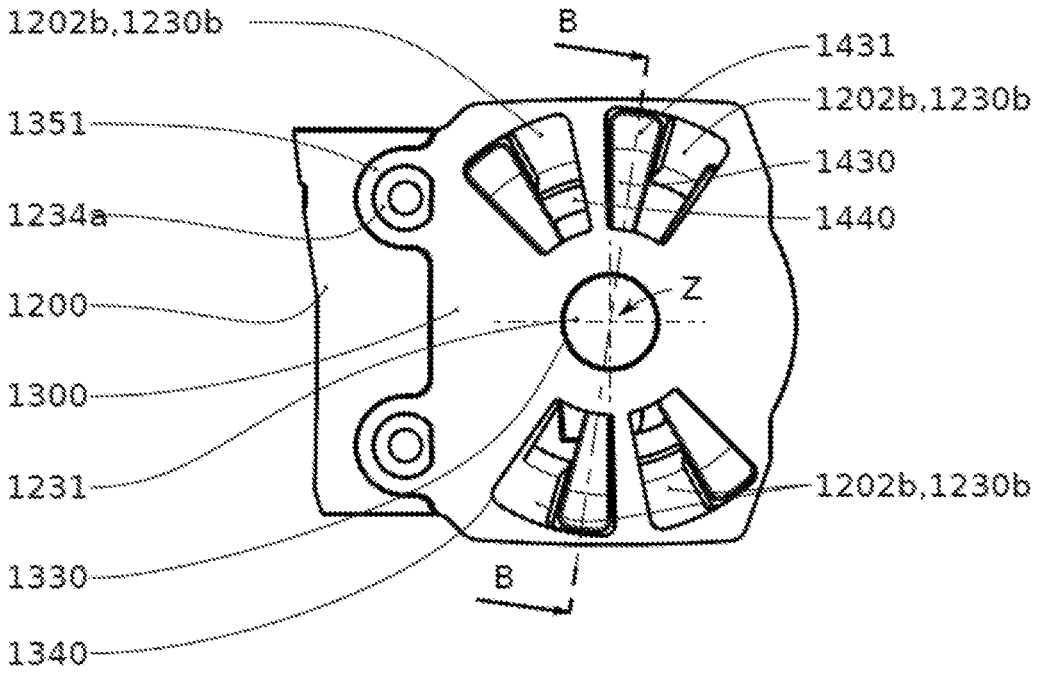
[Fig. 5B]
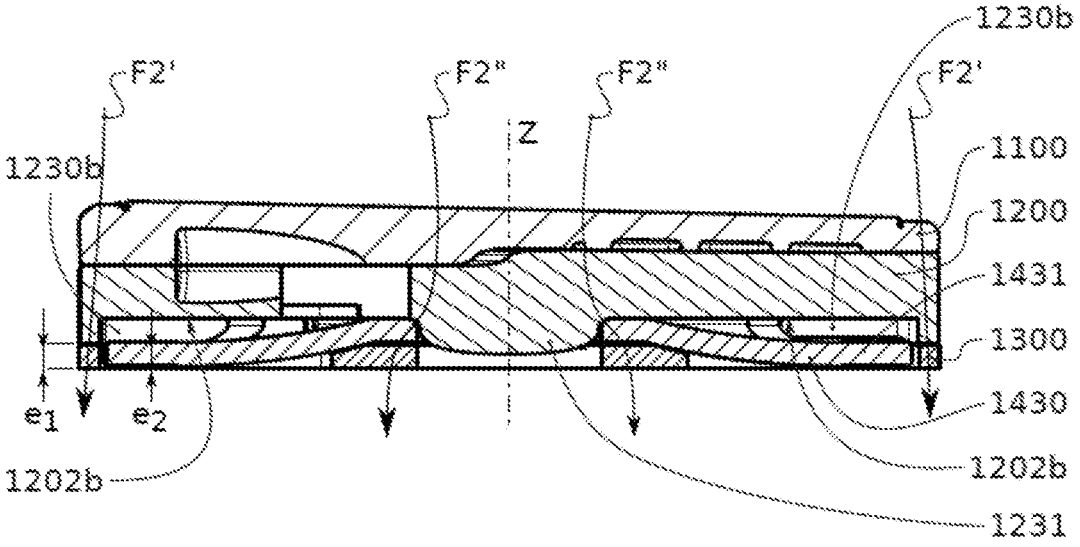

[Fig. 6A]
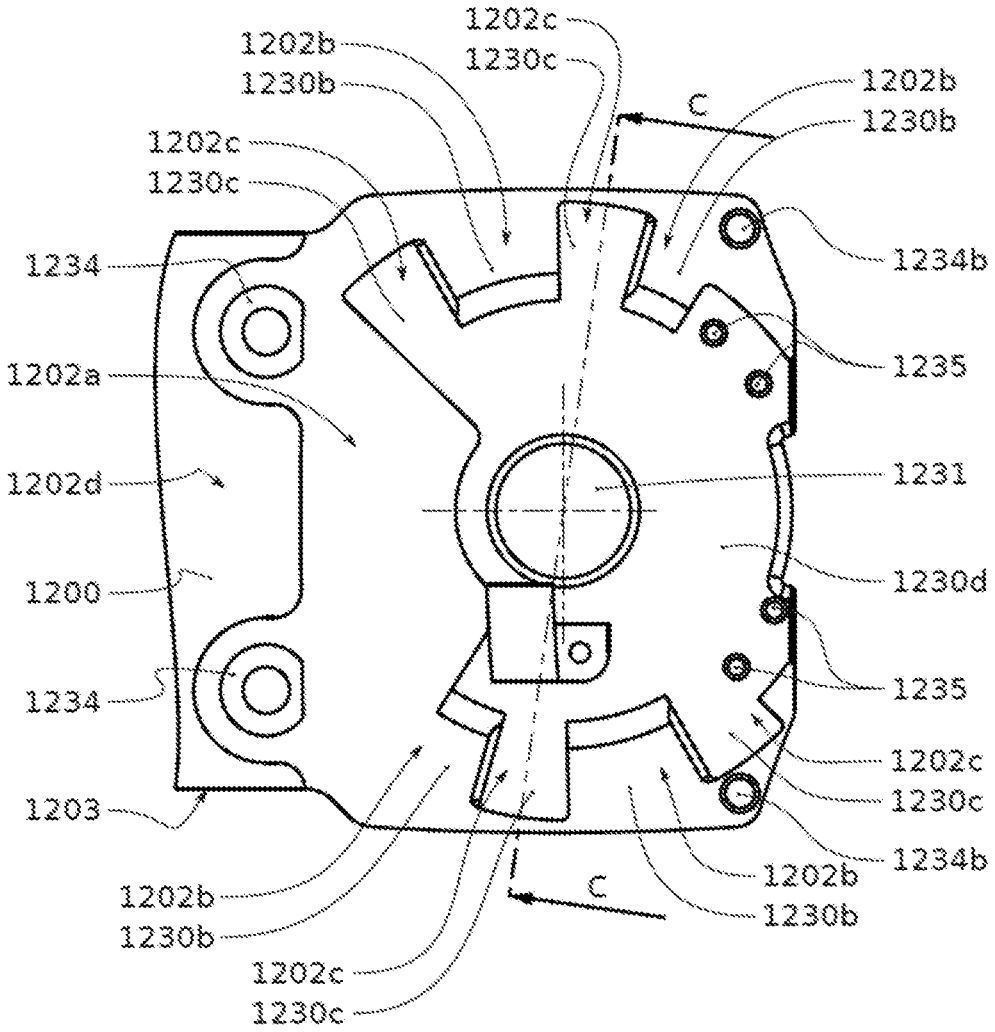
[Fig. 6B]
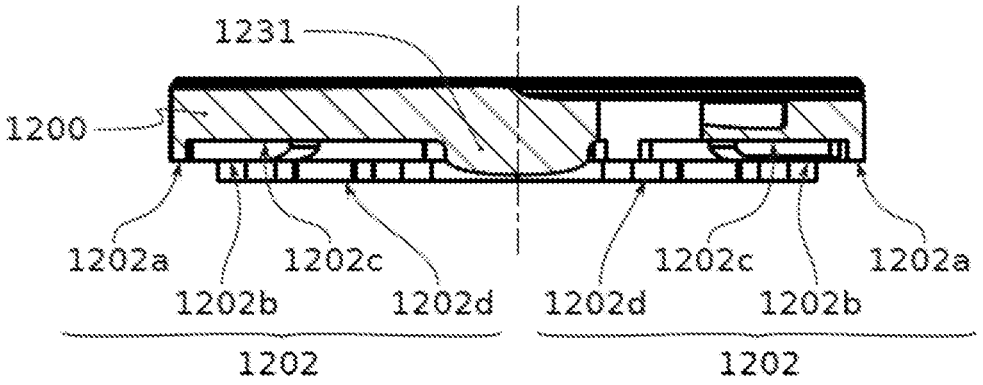

SUPPORT PLATE FOR A GLIDING BOARD

CROSS-REFERENCE TO RELATED APPLICATION

This application is based upon French Patent Application No. FR 19 05863, filed Jun. 3, 2019, the disclosure of which is hereby incorporated by reference thereto in its entirety, and the priority of which is claimed under 35 U.S.C. § 119.

BACKGROUND

1. Field of the Invention

The invention relates to the field of bindings for gliding boards, and more particularly relates to a support plate for such a binding. The invention is applicable to gliding sports, in particular downhill skiing and ski touring.

2. Background Information

Bindings on gliding boards for shoes or boots, hereafter "shoes," generally comprise at least one retaining element, configured to hold the shoe on the gliding board, and a support plate on which the sole of the shoe takes support when it is engaged with the retaining element. The support plate comprises a chassis, fixed on an upper surface of the gliding board, and a support element on which the sole of the shoe takes support.

There are commercially available support plates comprising a rubber damping plate interposed between the chassis of the support plate and the upper surface of the ski. This construction makes it possible to provide flexibility and elasticity to the shoe support. However, this stiffness is not adjustable.

A support plate is also known from the patent document EP 0595170, such support plate comprising a chassis, a support element, one end of which is connected to the chassis via an elastically deformable zone, and a wedge enabling the support stiffness, or hardness or rigidity, to be adjusted. The support plate can have two configurations, including a flexibility configuration and a stiffness configuration, thus making it possible to adapt the behavior of the binding as desired by the user. The user can thus give preference to damping and his comfort by selecting the flexibility configuration, or conversely, can give preference to responsiveness and the precision in controlling the gliding board by selecting the stiffness configuration.

In the flexibility configuration, under the effect of a vertical force, the support element is capable of performing a downward movement until reaching a stop, by bending the elastically deformable zone. The rigid configuration is obtained by blocking the bending movement and, consequently, immobilizing the support element. The blocking is achieved through a wedge acting as a stop between the support element and the chassis. The transition from one configuration to the other is carried out by pulling or rotating the wedge, for example with a screwdriver.

However, this support plate has drawbacks. In particular, when using the support plate in the flexibility configuration, the successive deformations of the deformable region can cause fatigue of said zone, or even its rupture, limiting the stability of the rigid and/or flexible behavior over time, or even the lifetime of the ski binding.

SUMMARY

The present invention provides a binding support plate for a gliding board having improved robustness compared to the solution described above.

The present invention also provides a solution for adapting the behavior of the binding, in particular the stiffness of the shoe support on the support plate, while maintaining a stable behavior over time.

Other objects, characteristics, and advantages of the present invention will become apparent upon examining the following description and the accompanying drawings. It is to be understood that other advantages can be incorporated.

To achieve this objective, the invention relates to a support plate for the binding of a gliding apparatus, the support plate comprising:

- a chassis configured to be fixed on an upper surface of a gliding board, the chassis carrying a support surface configured to be in contact with a lower portion of a sole of a shoe;
- a damping plate configured to be at least partially interposed between a first portion of a lower surface of the chassis and the upper surface of the gliding board.

The support plate comprises a wedge made of a material that is less compressible than the material constituting the damping plate, the wedge being movable between at least:

- a hardness configuration for which a transmission portion of the wedge is positioned opposite a second portion of the lower surface of the chassis;
- a flexibility configuration for which the transmission portion of the wedge is positioned opposite a third portion of the lower surface of the chassis, the third portion being set back in relation to the second portion.

Thus, the hardness configuration enables the force between the shoe and the gliding board to be transmitted mainly via the wedge without damping, which makes it possible to provide greater control to the user. In the flexibility configuration, because the third portion is set back, the transmission portion of the wedge can freely deform/move. This results in inhibiting the effect of the wedge. Thus, the force is mainly transmitted to the damping plate which damps it at least partially, which makes it possible to provide greater comfort to the user. In addition, the hardness and flexibility configurations of the support plate are obtained by a transmission of the force mainly via compression of a more or less hard material. The risk of fracture of the material is therefore minimized compared to a transmission of the force via a bending of an elastically deformable material as proposed in the patent document EP 0595170 mentioned above. Thus, the robustness and stability of the hardness and flexibility configurations are improved over time.

Optionally, the invention may further have at least any of the following features.

According to an example, the wedge, the damping plate and the chassis are arranged so that, in its hardness configuration, the wedge is positioned in relation to the chassis so that, when a vertical force is exerted, typically by the sole, the chassis retransmits the force to the upper surface of the gliding board, mainly via a portion of the wedge, inhibiting, at least partially, a compression of the damping plate between the chassis and the gliding board under the effect of this force.

According to one example, the wedge, the damping plate and the chassis are arranged so that, in its flexibility configuration, the wedge is positioned in relation to the chassis so that, when the vertical force is exerted, typically by the sole, the chassis retransmits the force to the upper surface of the gliding board, mainly via the damping plate, inhibiting, at least partially, a compression of the wedge between the chassis and the gliding board.

According to one example, the wedge can be rotatably mounted on the chassis in relation to a vertical axis. According to an alternative embodiment, the wedge can be slidably mounted on the chassis along a translational movement in the axis longitudinal or transverse to the upper surface of the gliding board, or even a combination of rotational and/or translational movements.

According to one example, the wedge may comprise a control member, which can be manipulated by the user, enabling the wedge to be tilted selectively from one configuration to the other.

According to one example, the wedge may further comprise at least one elastic tab, and according to one embodiment, a non-compressible elastic tab, the end of which forms the transmission portion.

According to one example, said at least one elastic tab can be elastically deformable in bending.

According to one example, the damping plate can comprise or be entirely formed by a damping portion made of a material having a hardness less than 80 Shore A, such as rubber or polypropylene.

According to one example, the chassis comprises at least one deactivation recess arranged so as to be positioned vertically opposite a portion of the wedge, when the wedge is positioned in the flexibility configuration, the support plate being configured so that at least a portion of the damping plate compresses without the wall of the deactivation recess coming into contact with said portion of the wedge.

According to one example, the thickness of the damping portion of the damping plate can be between 2.0 mm and 5.0 mm.

According to one example, the damping plate comprises mechanisms for affixing to the chassis.

According to one example, the lower surface of the chassis may have a fourth portion extending mainly in a plane and intended to come and take support on the upper surface of the gliding board, and a housing extending from the contact surface and in the direction of the upper surface of the chassis, the housing and the damping plate being configured so that the lower surface of the damping plate can be flush with the fourth portion of the lower surface of the chassis.

According to one example, the support surface is carried by a support element, the support plate being able to be fixed to the chassis. According to a particular example, the support element can be movably mounted on the chassis, preferably said support element can be slidably mounted along a direction transverse to a longitudinal direction of the chassis.

According to another aspect, the invention relates to a binding comprising a support plate as defined above.

According to another aspect, the invention relates to a gliding board comprising a support plate as defined above.

BRIEF DESCRIPTION OF DRAWINGS

Other characteristics and advantages of the invention will be better understood from the description that follows, with reference to the annexed drawings illustrating, by way of non-limiting embodiments, how the invention can be carried out, and in which:

FIG. 1 shows an overall perspective view of the gliding board binding comprising the support plate according to an exemplary embodiment;

FIG. 2 shows an exploded perspective and top view of the support plate illustrated in FIG. 1;

FIG. 3 shows an exploded perspective and bottom view of the support plate illustrated in FIG. 1;

FIG. 4A shows a bottom view of the support plate illustrated in FIG. 1, in the hardness configuration;

FIG. 4B is a cross-sectional view, along the line A-A of FIG. 4A;

FIG. 5A shows a bottom view of the support plate illustrated in FIG. 1, in the flexibility configuration;

FIG. 5B is a cross-sectional view, along the line B-B of FIG. 5A;

FIG. 6A shows a bottom view of the chassis of the support plate illustrated in

FIG. 1;

FIG. 6B is a cross-sectional view, along the line C-C of FIG. 6A;

The drawings are given as examples and are not limiting to the invention. They constitute schematic representations intended to facilitate the understanding of the invention and are not necessarily to scale for practical applications. In particular, the thicknesses and dimensions of the various portions can be modified.

DETAILED DESCRIPTION

The following description makes use of terms such as "vertical", "longitudinal", "transverse", "upper", "lower", "top", "bottom", "front", "rear". These terms should be considered as relative terms in relation to the normal position of use of a support plate assembled on a gliding board. For example, "longitudinal" means with respect to the longitudinal axis of the board.

Also, reference points are used in which the rear/front direction corresponds to the X axis, the transverse or right/left direction corresponds to the Y axis, and the vertical or bottom/top direction corresponds to the Z axis.

In the following description, the term vertical force will relate to both a vertical downward force exerted by a shoe towards the ground and an upward vertical reaction force exerted by the ground towards toward the shoe.

An example of a support plate 1000 according to the invention will next be described in detail with reference to FIGS. 1 to 5B.

The support plate 1000 according to the present invention is intended to be coupled to a binding of a gliding board 2000, for example a ski. As illustrated in FIG. 1, the binding comprises a shoe front retaining element 3000 and the support plate 1000 according to the invention. The front retaining element 3000 and its assembly to the gliding board 2000, or even to a chassis 1200 of the support plate 1000, are conventionally known. It is notable that the chassis 1200 of the support plate 1000 can also be the chassis of the front retaining element 3000. A person with ordinary skill in the art can refer to a number of existing solutions.

The support plate 1000 is arranged on an upper surface 2100 of the gliding board 2000. The support plate comprises a chassis 1200. The chassis 1200 comprises a lower surface 1202 oriented opposite the upper surface 2100 of the gliding board 2000. The lower surface 1202 is comprised of a plurality of portions 1202*a*, 1202*b*, 1202*c*, and 1202*d*. The portion 1202*d* corresponds to the portion of the lower surface 1202 intended to be in contact with the upper surface of the gliding board. The portions 1202*a*, 1202*b*, and 1202*c* are set back from the portion 1202*d*. A portion is "set back" from a reference portion when it is offset upwards when the chassis is mounted on the gliding apparatus. Thus, a housing or recess is created opposite the set back portion, between this portion and the reference portion. The depth of this housing corresponds to the distance between the plane containing the set back portion and the plane containing the reference portion. In the illustrated embodiment, the first 1202*a*, second 1202*b*, and third 1202*c* portions correspond to continuous lower surfaces of the chassis 1200. Alternatively, one or more portions may be comprised of a plurality of distinct surfaces having the same depth, that is to say, each of the distinct surfaces characterizing a portion has the same distance between the plane of this distinct set back surface and the plane containing the reference portion. The reference portion 1202*d* can also be formed of a plurality of distinct surfaces. Having portions forming a discontinuous surface or, in other words, a set of separate surfaces having the same set back position, makes it possible to obtain a chassis with less material and therefore to lighten the portion.

The chassis 1200 also carries a support surface 1110 intended to be in contact with a lower portion of a sole of a shoe, for example a ski boot.

According to one embodiment, the support surface 1110 is supported by a support element 1100 mounted on the chassis. As illustrated in FIG. 2, the support element 1100 has an upper surface corresponding to the support surface 1110. This support surface 1110 can be configured so as to facilitate the sliding and thereby the insertion of the shoe in the retaining element. For example, the support surface 1110 is not very structured, and is even mainly smooth.

According to a first example, the support element 1100 is affixedly mounted on the chassis 1200. For this, the support element 1100 can be fixed to the chassis by any suitable means, such as one or more screws, clips, glue, and welding, for example.

According to one embodiment, the support element 1100 can be removably mounted on the upper surface 1201 of the chassis 1200. This enables the user, for example, to change the support element, and in particular to use support elements of various heights and/or of various hardnesses or rigidities, so that the behavior of the binding is adaptable to add degrees of comfort or control for the user.

According to a particular embodiment, such as that described in FIGS. 2 and 3, the support element 1100 is movably mounted in translation on an upper surface 1201 of the chassis 1200. The direction of translation is transverse to the longitudinal direction of the shoe, that is to say, the longitudinal direction of the binding or the gliding apparatus. This makes it easier to take off the shoe transversely. Thus, in the event of a fall, the support element 1100 can slide on the chassis 1200 and limit the retention of the shoe within the binding. The safety of the binding is improved by facilitating the shoe removal. This construction is classic and known to one with ordinary skill in the art.

According to another example not illustrated, the support plate 1000 does not include a support element 1100. The sole of the shoe is then in direct contact with the upper surface 1201 of the chassis 1200.

The support plate 1000 also comprises a damping plate 1300 configured, at least in a configuration of use, to damp at least a portion of the vertical forces applied by the shoe onto the support element 1100 or of the vertical reaction forces applied by the ground (for example snow or ice) to the shoe. Thus, this damping plate 1300 absorbs a portion of the impacts between the ground and the shoe, and thus improves the comfort of the user.

The damping plate 1300 is shaped, in particular its material and its thickness, so as to at least partially damp a force corresponding to a gliding phase with a reception phase on the ground, a braking phase, a phase of evolution in a curve, or a shock absorption phase due to a relief of the ground. This compression increases with the amplitude of the force exerted.

In a particular embodiment, the damping plate 1300 is interposed between a first portion 1202*a* of the lower surface 1202 of the chassis 1200 and the upper surface 2100 of the gliding board 2000. The first portion 1202*a* is set back in relation to the portion 1202*d* of the lower surface of the chassis. According to one embodiment, the first portion 1202*a* is offset upwards, in relation to the portion 1202*d*, by a distance equal to or substantially equal to the thickness e1 of the damping plate. Thus, when the damping plate is positioned on the chassis, it is positioned in a first housing opposite the first portion 1202*a*. In this configuration, a lower surface 1320 of the damping plate is flush or substantially flush with the portion 1202*d* of the lower surface 1202 of the chassis while the upper surface of the damping plate is in contact with the first portion 1202*a* of the lower surface of the chassis.

According to one embodiment, the damping plate 1300 is at least partially in contact with the upper surface 2100 of the gliding board 2000.

The chassis 1200 is further suitable for receiving at least one wedge 1400. This wedge 1400 is made of a material that is less compressible than the material forming the damping plate 1300. This wedge 1400 can thus be defined as rigid.

This wedge 1400 is movable in relation to the chassis between at least two configurations.

A first configuration is a hardness configuration for which a transmission portion 1431 of the wedge 1400 is positioned opposite a second portion 1202*b* of the lower surface 1202 of the chassis. The second portion 1202*b* is set back in relation to the portion 1202*d* of the lower surface of the chassis. According to one embodiment, the second portion 1202*b* is offset upwards, in relation to the portion 1202*d*, by a distance equal to or substantially equal to the thickness of the transmission portion of the wedge. Thus, when the transmission portion 1431 of the wedge 1400 is positioned in a second housing opposite the second portion 1202*b* of the lower surface 1202 of the chassis, the lower surface of the transmission portion is flush or substantially flush with the portion 1202*d* of the lower surface of the chassis while the upper surface of the transmission portion is in contact with the second portion 1202*b* of the lower surface of the chassis.

In this hardness configuration, the transmission portion 1431 of the wedge 1400 is positioned in relation to the chassis 1200 so that, when a vertical force is exerted, typically by the sole, the chassis 1200 retransmits the force to the upper surface 2100 of the gliding board 2000, mainly via a portion of the wedge 1400, inhibiting, at least partially, a compression of the damping plate 1300 between the chassis 1200 and the gliding board 2000 under the effect of this force. Thus, in this hardness configuration, the force between the shoe and the gliding board 2000, or the force between the ground and the shoe, is transmitted via the wedge 1400 without damping, or with less damping than when this force is transmitted via the compression plate 1300, thereby making it possible to provide greater control to the user.

A second configuration is a flexibility configuration for which the transmission portion 1431 of the wedge 1400 is positioned opposite a third portion 1202*c* of the lower surface 1202 of the chassis. The third portion 1202*c* is set back in relation to the second portion 1202*b* of the lower surface of the chassis. According to one embodiment, the third portion 1202*c* is offset upwards, in relation to the second portion 1202*b*, by a distance greater than the thickness of the transmission portion of the wedge. Thus, when the transmission portion is positioned in a third housing opposite a third portion 1202*c* of the lower surface 1202 of the chassis, the lower surface of the transmission portion is flush or substantially flush with the portion 1202*d* of the lower surface of the chassis while the upper surface of the transmission portion is distant from the second portion 1202*b* of the lower surface of the chassis. The transmission portion is therefore no longer in contact with the chassis.

In this flexibility configuration, the transmission portion 1431 of the wedge 1400 is positioned in relation to the chassis 1200 so that, when the vertical force is exerted, typically by the sole, the chassis 1200 retransmits the force to the upper surface 2100 of the gliding board 2000, mainly via the damping plate 1300, inhibiting, at least partially, a compression of the wedge 1400 between the chassis 1200 and the gliding board 2000. In the flexibility configuration, the force between the shoe and the gliding board 2000 or the force between the ground and the shoe is transmitted via the damping plate 1300 which damps it at least partially, thus bringing greater comfort to the user.

Thus, the flexibility configuration of the support plate 1000 is obtained by a transmission of the force mainly via the compression of the material of the damping plate 1300. This enables the support plate 1000 to generate a stable behavior over time and to be particularly robust.

According to one embodiment, the damping plate 1300 is made of a material having a hardness of less than 80 Shore A. The damping plate 1300 can be made for example of rubber or polypropylene.

According to one embodiment, the wedge 1400 is made of a material that is not very compressible. Thus, the wedge does not deform or deforms only slightly in compression, or by no more than 5% of its thickness, when it is subject to a compressive force less than or equal to 100 kg. Such a material can, for example, have a modulus of elasticity greater than 2,500 MPa.

The 1400 wedge can be a monolithic piece. Alternatively, it can include, or be formed from, a stack of layers. It can comprise, or be formed of, a matrix possibly embedded in an encapsulant less rigid than the matrix. This can reduce the weight of the wedge 1400.

The alternative transition from the hardness configuration to the flexibility configuration is carried out by manipulation of a control member 1410, and carried, or formed, by the wedge 1400. The user can thus adapt the configuration of the support plate 1000 as desired, for example depending on his fitness level or snow conditions.

The control member 1410, or controller, can be accessible manually by the user, without requiring any additional tool. This control member clearly appears in FIGS. 1, 2, and 3. In this example, the control member 1410 is positioned so as to be located under the sole when the shoe is in engagement with the retaining element 3000 of the binding. This makes it possible to protect this control member 1410 during a gliding phase. This prevents the control member 1410 from involuntary manipulation, or even getting hooked, when using the gliding board, for example during contact between two skis or during an impact. According to an embodiment not illustrated, one can conversely provide that the control member 1410 be accessible by the user even when the shoe is engaged with the retaining element. This makes it possible to adjust the comfort or the control without having to take off the shoes.

The cooperation between the chassis 1200, the damping plate 1300, and the wedge 1400 will next be described in detail.

The chassis 1200, the damping plate 1300, and the wedge 1400 are arranged so that a movement of the movable wedge 1400, actuated by the control member 1410, makes it possible to selectively obtain either one of the hardness or flexibility configurations. This movement of the wedge 1400 can be a translation, a rotation, or even a combination of translation and rotation. For example, the movement of the control member 1410, between two "soft" and "hard" stops as illustrated in FIG. 2, can cause this movement of the wedge 1400. In the example illustrated, the wedge 1400 is rotatably movable about a vertical axis or a substantially vertical axis during a use phase, that is to say, most often about an axis perpendicular or substantially perpendicular to the upper surface 2100 of the gliding board 2000.

To obtain the hardness configuration, the wedge 1400 is positioned so that at least one transmission portion 1431 of the wedge is in contact with the chassis 1200, more particularly with the second portion 1202*b* of the lower surface 1202 of the chassis 1200, on the one hand, and with the upper surface 2100 of the gliding board 2000, on the other hand. The wedge 1400 being made of a material less compressible than the material forming the damping plate 1300, the force between the shoe and the gliding board 2000 or the force between the ground and the shoe is transmitted via the wedge 1400.

To obtain the flexibility configuration, the wedge 1400 is positioned so that at least one transmission portion 1431 of the wedge is opposite the third portion 1202*c* of the lower surface 1202 of the chassis 1200. This third portion 1202*c* is sufficiently distant from the upper surface 2100 of the gliding board 2000 so that the transmission portion of the wedge is not in contact with the third portion 1202*c* when the wedge is in the flexibility configuration. Furthermore, at least a portion of the damping plate 1300, called the damping portion, is in contact with the first portion 1202*a* of the lower surface 1202 of the chassis 1200, on the one hand, and with the upper surface 2100 of the gliding board 2000, on the other hand. Consequently, in this configuration, the force between the shoe and the gliding board 2000 or the force between the ground and the shoe is transmitted via the damping plate 1300. During this bias, the transmission portion 1431 of the wedge will move/deform in the space allocated opposite the third portion 1202*c*.

Naturally, even in the hardness configuration, the lower surface 1202 of the chassis 1200 can be provided to initially compress a portion of the damping plate 1300, and, thereafter, to come into abutment on the wedge 1400. In this case, the wedge 1400 does not entirely inhibit the deformation of the damping plate 1300 but inhibits a portion thereof. Depending on the dimensions of the damping plate 1300 and the wedge 1400, it is possible to provide for the user to perceive a first damping phase before perceiving a hardness phase.

The wedge 1400 can comprise a portion interposed between the chassis 1200 and the damping plate 1300. The wedge 1400 can be contained between the chassis 1200 and the damping plate 1300 and, in a particular embodiment, with the exception of the control member 1410 accessible manually by the user. Thus, unlike a configuration as described by the patent document EP 0595170, the wedge is protected from possible impacts, thereby improving the stability of the flexibility and hardness configurations over time.

Furthermore, the wedge 1400 can be the only movable element of the assembly formed by the chassis 1200, the damping plate 1300 and the wedge 1400. For this, the wedge 1400 is rotatably or translationally mounted, or mounted so as to allow a combination of translation and rotation, on the chassis 1200, more particularly on the lower surface 1202 of the chassis 1200, on the one hand; and the damping plate 1300 is fixedly mounted in relation to the chassis 1200, on the other hand.

In addition, the damping plate 1300 can be inserted in the chassis 1200, more particularly in the first housing 1230*a* suitable for receiving the damping plate 1300 opposite the first portion 1202*a* of the lower surface 1202 of the chassis, for example as illustrated in FIG. 3. Thus, the chassis 1200 protects the damping plate 1300, in particular the upper surface of the damping plate 1300, from possible impacts and external aggressions such as frost, thereby contributing to the robustness of the support plate 1000. The damping plate 1300 can be entirely covered by the chassis 1200, only its edge remaining accessible from the outside once the chassis 1200 is mounted on the damping plate 1300.

A structural example of the cooperation between the chassis 1200, the damping plate 1300, and the gliding board 2000 is next described in detail. As illustrated in FIG. 3, the chassis 1200 comprises on its lower surface 1202 a fourth portion 1202*d*, designated as a contact surface, for example located at the front of the chassis 1200, intended to be in contact with the gliding board 2000. According to an embodiment, the first housing 1230*a* has a height equal to or substantially equal to the thickness e1 of the damping plate 1300, as illustrated in more detail in FIG. 4B. For example, the thickness e1 of the damping plate can be between 2.0 mm and 5.0 mm. Thus, at least a portion of the upper surface 1310 of the damping plate 1300 is in contact with the first portion 1202*a* of the surface 1202 of the first housing 1230*a*. At least a portion of the lower surface 1320 of the damping plate 1300 is in contact with the upper surface 2100 of the gliding board 2000 because this portion of the lower surface 1320 of the damping plate 1300 is flush, by construction, with the contact surface 1202*d* of the chassis.

The first housing 1230*a* of the chassis 1200 may further comprise mechanisms 1234*a* and 1234*b* for affixing the chassis 1200 to the damping plate 1300. Alternatively, or in combination, the damping plate 1300 may comprise mechanisms 1350 for affixing to the chassis 1200. According to the embodiment illustrated in FIGS. 2 and 3, the affixation mechanisms 1234*a* and 1234*b* of the chassis 1200 are configured to complement the affixation mechanisms 1350 of the damping plate 1300. For example, the damping plate 1300 comprises at least one opening 1351, more particularly two openings, complementary to at least one projection of material 1234*a* arranged in the first housing 1230*a* of the chassis 1200, facing the at least one opening 1351. The damping plate 1300 may further comprise at least one lug 1352, more particularly two lugs 1352, each lug 1352 being complementary to at least one assembly recess 1234*b*, for example a blind hole, arranged in the first housing 1230*a* opposite the at least one lug when the damping plate 1300 is mounted on the chassis 1200. These affixation mechanisms facilitate the positioning of the damping plate 1300 in relation to the chassis 1200 and their maintenance.

A structural example of the cooperation of the wedge 1400 with the chassis 1200 and the damping plate 1300 is next described in detail. The movable wedge 1400 is mainly interposed between the chassis 1200 and the damping plate 1300. To guide the movement of the wedge 1400, the chassis 1200 may comprise a projecting element 1231, the wedge comprising a complementary profile 1330 to this projecting element 1231. In the example illustrated, the movement of the wedge 1400 being a rotation, the projecting element 1231 can be provided to have a circular cross section or substantially circular cross section and the wedge 1400 to have an opening 1420 complementary to this cross section and within which the projecting element 1231 is inserted. Thus, the projecting element 1231 acts as a shaft on which the wedge 1400 is rotatably mounted.

The dimensions of the circular projecting element 1231 can be selected so as to allow the rotation of the wedge 1400 while minimizing its lateral displacements. For example, the diameter of the projecting element 1231 is less than the diameter of the opening 1420 so that there is a slight clearance between the projecting element 1231 and the opening 1420. Furthermore, the thickness of the projecting element 1231 can be greater than the height of the walls of the opening 1420, and less than the sum of the height of the walls of the opening 1420 and the thickness e1 of the damping plate 1300. According to this example, the damping plate 1300 comprises a circular opening 1330 suitable for being arranged around the projecting element 1231. Similarly, the diameter of the circular opening 1330 of the damping plate 1300 can be selected so that there is a slight clearance between the projecting element 1231 and the circular opening 1330.

More particularly, the projecting element 1231 is arranged in a lower recess 1230 of the chassis, suitable for at least partially receiving the wedge 1400, and configured so as to allow the movement of the wedge 1400.

In the illustrated embodiment, this projecting element 1231 is supported by the chassis 1200. Alternatively, the construction is reversed, the projecting element is a portion of the wedge, and the chassis comprises a hole for receiving the projecting element of the wedge. According to another embodiment, it is possible to provide that the wedge 1400 be guided by the damping plate 1300. In this case, it is the latter that carries the projecting element 1231.

According to an embodiment not illustrated, the device comprises fixing mechanisms making it possible to maintain the wedge 1400 assembled on the chassis 1200. For example, this assembly can be carried out by clipping. The chassis 1200 and/or the wedge 1400 can carry an elastic tab or an elastically deformable element.

The lower recess 1230 comprises the first 1230*a*, second 1230*b*, and third 1230*c* housings located in relation to the first 1202*a*, second 1202*b*, and third 1202*c* portions, respectively, of the lower surface 1202 of the chassis 1200. The lower recess 1230 also comprises a fourth recess 1230*d* to contain the body of the wedge, except for the transmission portion 1431.

In this example, the first 1202*a*, second 1202*b* portions of the lower surface 1202 of the chassis 1200 are at the same level; in other words, the second portion 1202*b* is flush with the first portion 1202*a*.

The third housing 1230*c* is intended to constitute a housing for deactivating the transmission of the force, in the flexibility configuration. For this, in the flexibility configuration, the third housing is intended to be opposite at least one transmission portion 1431 of the wedge 1400, so that this portion of the wedge is not in contact with the chassis 1200 along a direction orthogonal to the main plane of the support plate 1000. The depth of this third housing, that is to say, the distance between the plane containing the portion 1202*d* and the plane containing the portion 1202*c*, is therefore selected so as to prevent the wedge 1400 from being brought into contact with the chassis 1200, along a direction orthogonal to the main plane of the support plate 1000, when a force is exerted, and in particular during a possible deformation of the chassis 1200. At least, during a first phase where the force is exerted.

Adjoining the third housing 1230*c*, the second housing 1230*b* is intended to constitute a housing for activating the transmission of the force, in the hardness configuration. For this, at least a second portion 1202*b* of the lower surface 1202 of the chassis is intended to be opposite at least one transmission portion 1431 of the wedge 1400, so that the wedge 1400 is in contact with both the chassis 1200 and the upper surface 2100 of the gliding board 2000 along a direction orthogonal to the main plane of the support plate 1000.

According to an embodiment illustrated in FIG. 3, the lower recess 1230 comprises four second 1230*b* and third 1230*c* housings, arranged radially about the axis Z along which the wedge 1400 rotates, that is to say, in this non-limiting example, around the projecting element 1231. A portion of the third housings 1230*c* can form a recess in the chassis, between the portion 1202*b* and the portion 1202*c* of the lower surface 1202 of the chassis, which does not open onto the lateral walls 1203 of the chassis 1200. The same is true for the fourth housing 1230*d* capable of receiving the body of the wedge. This protects the 1400 wedge, in particular from external aggressions such as frost, snow, or road dirt that could become lodged on the wedge 1400 and prevent its movability.

A structural example of the wedge 1400 is next described. The wedge 1400 comprises the control member 1410 and at least one effector element for the transmission of the force in the hardness configuration. According to the embodiment illustrated in FIG. 3, the control member 1410 is connected to a ring forming the opening 1420 suitable for being arranged around the projecting element 1231 of the chassis 1200, by a piece of material located in the same plane as the ring. The at least one effector element for transmitting the force in the hardness configuration comprises at least one elastic tab 1430 connected to the ring, and the distal end 1431 of which is made from a non-compressible material. In this example, the distal end 1431 corresponds to the transmission portion of the wedge. According to an alternative embodiment, the elastic tab 1430 is made from an elastic and non-compressible material, deformable in bending. According to the example illustrated in FIG. 3, the wedge 1400 comprises four elastic tabs 1430, possibly connected to one another, for example by a bridging element 1440, so as to improve the robustness of the wedge 1400.

In order to allow the transition from one to the other of the configurations of the support plate 1000, the wedge 1400 and the damping plate 1300 are, for example, structurally arranged in the following manner. The at least one elastic tab 1430 is configured so as to be inserted into an opening 1340 of the damping plate 1300. In this fashion, the end 1431 of each elastic tab 1430 is capable of being in contact with the upper surface 2100 of the gliding board 2000, and this, whether in the hardness or the flexibility configuration of the support plate 1000. Furthermore, the opening 1340 of the damping plate 1300 can be adapted to allow the movement of the elastic tab 1430, caused by the movement of rotation, of translation, or even the combination of rotation and translation, of the movable wedge 1400, as illustrated for example in FIG. 4A. In addition, the thickness e2 of the end 1431 of the elastic tab 1430 can be equal to or substantially equal to the thickness e1 of the damping plate 1300, as illustrated in FIG. 4B.

A structural example of the respective hardness and flexibility configurations is now described. We consider the particular embodiment according to which the support plate 1000 is configured so as to allow for a rotational movement about the axis Z of the wedge 1400, comprising four elastic tabs, as illustrated in FIGS. 4A to 5B.

As illustrated in FIGS. 4A and 4B, in the hardness configuration, the distal end or transmission portion 1431 of each elastic tab 1430 is arranged in a second housing 1230*b*, opposite a second portion 1202*b* of the lower surface 1202 of the chassis. Thus, the ends 1431 of the elastic tabs 1430 are in contact, or very close, on their upper surface, with the chassis 1200, and more particularly with the second portion 1202*b* of the housing 1230*b*, and on their lower surface, with the upper surface 2100 of the gliding board 2000.

When a vertical force is transmitted to the support plate 1000, for example applied by a shoe to the support plate 1000, this force is transmitted, via their respective contact surfaces, from the sole of the shoe to the chassis 1200, and then, from the chassis to the wedge 1400, and more particularly to the end 1431 of an elastic tab 1430, and finally, from the wedge to the upper surface 2100 of the gliding board 2000, as represented by the arrows F1 in FIG. 4B. As a result, the compression of the damping plate 1300 is inhibited. The force between the shoe and the gliding board 2000 is thus transmitted via the wedge with less damping than if the force was transmitted by the damping plate 1300, or even without damping, making it possible to provide greater control to the user.

As illustrated in FIGS. 5A and 5B, in the flexibility configuration, the elastic tabs are arranged in a third housing 1230*c*, facing a third portion 1202*c* of the lower surface 1202 of the chassis. Thus, the ends 1431 of the elastic tabs 1430 are each opposite a third portion 1202*c* of the lower surface 1202 of the chassis. However, a space separates the upper surface from the transmission portions of the third portion 1202*c*.

When a vertical force is transmitted to the support plate 1000, for example applied by a shoe to the support plate 1000, this force is transmitted, by their respective contact surfaces, from the sole of the shoe to chassis 1200, and then, from the chassis 1200 to the damping plate 1300, and finally, from the damping plate to the upper surface 2100 of the gliding board 2000, as shown by the arrows FT and F2" in FIG. 5B. This force either does not transit through the wedge 1400 (arrows F2'), or transits through the wedge 1400 and through the damping plate 1300 (arrow F2"). Regardless of the path of the force (F2' or F2"), the force between the shoe and the gliding board 2000 is transmitted in a damped fashion by the damping plate 1300, thus bringing greater comfort to the user.

In addition, as each elastic tab 1430 is deformable in bending, the mechanical stresses that can be exerted on the wedge 1400, during its movement between one and the other of the configurations, are minimized. In particular, the mechanical stresses are minimized during the insertion of the end 1431 of the elastic tab 1430 between the surface 1202 of the housing 1230 of the chassis 1200 and the upper surface 2100 of the gliding board 2000, for the transition to the hardness configuration as shown in FIG. 4B. During this transition, the elastic tab 1430 can slide on the wall of the housing 1230 of the chassis 1200 while being elastically deformed.

According to a particular embodiment, indexing elements can be incorporated into the support plate 1000 so as to stabilize one and/or the other of the configurations. According to the example illustrated in FIG. 3, the wedge 1400 may comprise at least one indexing lug 1450, intended to be inserted in at least one complementary indexing recess 1235 made in the chassis 1200, or even in the fourth housing 1230*d* of the chassis. When the wedge 1400 is in the hardness configuration, at least one indexing lug 1450 can be inserted into a corresponding indexing recess 1235. Similarly, when the wedge 1400 is in the flexibility configuration, the at least one indexing lug 1450 can be inserted in a second corresponding indexing recess 1235. In this example, the wedge comprises two indexing lugs 1450 for four indexing recesses 1235. A rotational indexing of the wedge 1400 is thus achieved, enabling the user to verify that he/she has effectively brought the wedge 1400 in the desired position. Furthermore, these indexing mechanisms help to maintain the wedge 1400 in this stable position selected by the user. Other indexing elements are also within the scope of the invention.

It is to be understood that additional recesses can be made on the elements included in the support plate 1000, so as to limit its weight and thus lighten the binding of the gliding board.

The invention is not limited to the embodiments described above and extends to all the embodiments covered by the claims.

The invention is not limited to these embodiments. It is possible to combine these embodiments.

For example, the damping plate 1300 can be provided to be monolithic or not. It can for example be made of a single material, more compressible than the material forming the wedge. Alternatively, it can be formed from a stack of layers, of various hardnesses and possibly of various thicknesses. At least one of these layers forms a damping portion and has less hardness than that of the wedge.

A stack of layers having various hardnesses can, for example, make it possible to vary the progressiveness of the damping, as a function of the amplitude of the vertical force received by the chassis 1200. For example, one can provide a damping that is or is not linear.

Furthermore, if the damping plate 1300 has a rigid upper layer such as an upper coating, this can make it possible to reduce the coefficient of friction between the wedge 1400 and the damping plate 1300, even when a force is exerted by the user. For example, when the force is static and limited to the weight of the user, the coefficient of friction between the wedge 1400 and the damping plate 1300 allows for and facilitates the displacement of the wedge 1400. The user can then modulate the damping provided by the binding even when the shoe is engaged with the binding. It will then be necessary to provide that the control member 1410 be accessible in the presence of the shoe. The thicknesses and materials of the various layers will be selected so that the damping plate 1300 effectively plays its damping role.

The wedge can also be provided to be movable between more than two configurations, one of the configurations being an intermediate configuration, in which the chassis, during a first phase, partially compresses the damping plate and then abuts on the wedge, which stops the compression of the damping plate. This embodiment offers a compromise between the hardness and flexibility configurations to the user. It enables a damping on limited impacts while maintaining precise control of the gliding board.

Further, at least because the invention is disclosed herein in a manner that enables one to make and use it by virtue of the disclosure of particular exemplary embodiments, such as for simplicity or efficiency, for example, the invention can be practiced in the absence of any additional element or additional structure that is not specifically disclosed herein.

The invention claimed is:

1. Support plate for binding a shoe to a gliding apparatus, the support plate comprising:

a chassis configured to be fixed onto an upper surface of a gliding board, the chassis carrying a support surface configured to be in contact with a lower portion of a sole of the shoe;

a damping plate configured to be at least partially interposed between a first portion of a lower surface of the chassis and the upper surface of the gliding board; and a wedge made of a material less compressible than a material forming the damping plate, the wedge being configured to move between at least:

a hardness configuration for which a transmission portion of the wedge is positioned opposite a second portion of the lower surface of the chassis;

a flexibility configuration for which the transmission portion of the wedge is positioned opposite a third portion of the lower surface of the chassis, the third portion being set back in relation to the second portion; and the wedge, the damping plate, and the chassis being arranged so that, in the hardness configuration, the wedge is positioned in relation to the chassis so that, when a vertical force is exerted by the sole, the chassis retransmits the force to the upper surface of the gliding board, mainly via a portion of the wedge, inhibiting, at least partially, a compression of the damping plate between the chassis and the gliding board under the effect of the force.

2. Support plate according to claim 1, wherein:

the wedge, the damping plate and the chassis are arranged so that, in the flexibility configuration, the wedge is positioned in relation to the chassis so that, when the vertical force is exerted by the sole, the chassis retransmits the force to the upper surface of the gliding board, mainly via the damping plate, inhibiting, at least partially, a compression of the wedge between the chassis and the gliding board.

3. Support plate according to claim 1, wherein:

the wedge is rotatably mounted on the chassis in relation to a vertical axis.

4. Support plate according to claim 1, wherein:

the wedge comprises a user-manipulatable controller configured to enable the wedge to be tilted selectively between the hardness and flexibility the configurations.

5. Support plate according to claim 1, wherein:

the wedge comprises at least one elastic tab, the elastic tab having an end forming the transmission portion of the wedge.

6. Support plate according to claim 5, wherein:

the at least one elastic tab is elastically deformable in bending.

7. Support plate according to claim 1, wherein:

the chassis comprises at least one deactivation recess configured and arranged to be positioned vertically opposite a portion of the wedge, when the wedge is positioned in the flexibility configuration; and the support plate is configured so that at least a portion of the damping plate compresses without a wall of the deactivation recess coming into contact with the portion of the wedge.

8. Support plate according to claim 1, wherein:

the damping plate comprises or is entirely formed by a damping portion made of a material having a hardness less than 80 Shore A.

9. Support plate according to claim 8, wherein:

the damping plate comprises or is entirely formed by a damping portion made of rubber or polypropylene.

10. Support plate according to claim 1, wherein:

the thickness of the damping portion of the damping plate is between 2.0 mm and 5.0 mm.

11. Support plate according to claim 1, wherein:

the damping plate comprises mechanisms for affixing to the chassis.

12. Support plate according to claim 1, wherein:

the lower surface of the chassis comprises a fourth portion extending mainly in a plane and configured to be supported on the upper surface of the gliding board and a housing extending from the contact surface and in the direction of the upper surface of the chassis;

the housing and the damping plate are configured so that the lower surface of the damping plate is flush with the fourth portion of the lower surface of the chassis.

13. Support plate according to claim 1, further comprising:

a support element carrying the support surface, the support element being configured to be movably mounted on the chassis.

14. Support plate according to claim 1, further comprising:

a support element carrying the support surface, the support element being slidably mounted on the chassis in a direction transverse to a longitudinal direction of the chassis.

15. Binding for gliding board comprising a support plate according to claim 1.

16. Gliding board comprising a binding according to claim 15.

17. Gliding board comprising a support plate according to claim 1.

18. Support plate for binding a shoe to a gliding apparatus, the support plate comprising:

a chassis configured to be fixed onto an upper surface of a gliding board, the chassis carrying a support surface configured to be in contact with a lower portion of a sole of the shoe;

a damping plate configured to be at least partially interposed between a first portion of a lower surface of the chassis and the upper surface of the gliding board; and a wedge made of a material less compressible than a material forming the damping plate, the wedge being configured to move between at least:

a hardness configuration for which a transmission portion of the wedge is positioned opposite a second portion of the lower surface of the chassis;

a flexibility configuration for which the transmission portion of the wedge is positioned opposite a third portion of the lower surface of the chassis, the third portion being set back in relation to the second portion;

the chassis comprising at least one deactivation recess configured and arranged to be positioned vertically opposite a portion of the wedge, when the wedge is positioned in the flexibility configuration; and the support plate being configured so that at least a portion of the damping plate compresses without a wall of the deactivation recess coming into contact with the portion of the wedge.

19. Support plate for binding a shoe to a gliding apparatus, the support plate comprising:

a chassis configured to be fixed onto an upper surface of a gliding board, the chassis carrying a support surface configured to be in contact with a lower portion of a sole of the shoe;

a damping plate configured to be at least partially interposed between a first portion of a lower surface of the chassis and the upper surface of the gliding board; and a wedge made of a material less compressible than a material forming the damping plate, the wedge being configured to move between at least:

a hardness configuration for which a transmission portion of the wedge is positioned opposite a second portion of the lower surface of the chassis;

a flexibility configuration for which the transmission portion of the wedge is positioned opposite a third portion of the lower surface of the chassis, the third portion being set back in relation to the second portion;

the lower surface of the chassis comprising a fourth portion extending mainly in a plane and configured to be supported on the upper surface of the gliding board and a housing extending from the contact surface and in the direction of the upper surface of the chassis; and the housing and the damping plate being configured so that the lower surface of the damping plate is flush with the fourth portion of the lower surface of the chassis.

* * * * *